United States Patent [19]

Igel

[11] 4,165,601

[45] Aug. 28, 1979

[54] CONTROL SYSTEM FOR YARN-TYING DEVICE OF THREAD-WINDING MACHINE

[75] Inventor: Wolfgang Igel, Ebersbach, Fed. Rep. of Germany

[73] Assignee: Zinser Textilmaschinen GmbH, Ebersbach, Fed. Rep. of Germany

[21] Appl. No.: 884,808

[22] Filed: Mar. 9, 1978

[30] Foreign Application Priority Data

Mar. 10, 1977 [DE] Fed. Rep. of Germany ..... 2710442

[51] Int. Cl.[2] ..... D01H 15/00; D01H 1/36

[52] U.S. Cl. ..... 57/264; 57/95; 57/261

[58] Field of Search ..... 57/34 R, 93, 94, 95, 57/98, 99, 261, 262, 264, 265

[56] References Cited

U.S. PATENT DOCUMENTS

| | | | |
|---|---|---|---|
| 3,072,350 | 1/1963 | Anderson et al. | 57/99 X |
| 3,128,590 | 4/1964 | Escursell | 57/34 R |
| 3,486,319 | 12/1969 | Lee, Jr. et al. | 57/34 R |
| 3,641,758 | 2/1972 | Escursell-Prat | 57/34 R |
| 3,728,852 | 4/1973 | Anderson et al. | 57/34 R |

*Primary Examiner*—John Petrakes
*Attorney, Agent, or Firm*—Karl F. Ross

[57] ABSTRACT

A yarn-tying device in a thread monitor patrolling a bank of spindles periodically receives enabling signals for at least one if its units from a drive mechanism serving for the vertical reciprocation of a ring rail associated with the spindles. The drive mechanism includes a rotary cam member and a follower member co-operating therewith, one of these members carrying a lug which trips a switch whenever the ring rail is in a position suitable for the operation of the controlled unit. The signal may be electrically transmitted to the moving thread monitor through a contact brush engaging a conductor strip on an overhead guide rail.

10 Claims, 5 Drawing Figures

CONTROL SYSTEM FOR YARN-TYING DEVICE OF THREAD-WINDING MACHINE

FIELD OF THE INVENTION

My present invention relates to a system for the control of a yarn-tying device of a thread-winding machine used for the spinning or twisting of filaments such as rovings or yarns to be wound on bobbin cores or cops that are placed on an array of rotating upright spindles surrounded by respective spinning rings which form tracks for thread-engaging travelers.

BACKGROUND OF THE INVENTION

It is known to patrol an array or bank of such spindles by an automatic thread monitor designed to detect the presence of a ruptured filament or loose thread end on any of the spindles. The thread monitor is mounted on a carriage also supporting a yarn-tying or filament-piecing device adapted to connect such a loose end with a fresh oncoming thread. Devices of this type have been described, for example, in U.S. Pat. Nos. 3,128,590 and 3,486,319.

In commonly owned U.S. patent application Ser. No. 875,077, filed by me jointly with Helmut Weiss on Feb. 3, 1978, there has been disclosed and claimed a component of a thread monitor serving to reinsert the loose end of a ruptured filament into the corresponding traveler preparatorily to tying it to a fresh thread. The loose end is picked up by a suction tube and held until a gripper and a coacting deflector can position it in the path of the traveler which is driven around its track by an air stream. The assembly of suction tube, gripper and deflector is supported on a ring rail serving as a common mounting for the track-forming spinning rings of the array, this mounting being vertically reciprocable during the building of the yarn packages to produce successive layers of oppositely slanting turns. A relative axial staggering of these layers, resulting in the formation of tapering extremities or chases on the several yarn packages, is brought about by the superposition of a progressive vertical motion upon the reciprocating traverse of constant stroke imparted to the ring mounting.

As discussed in U.S. Pat. No. 3,641,758, it is desirable to synchronize the operation of a yarn-piecing mechanism—or at least some service unit thereof such as the device for picking up a loose end—with the reciprocation of the ring mounting so as to establish an operating interval for that unit during a certain phase of a traverse, independently of the superimposed progressive shift of the spinning frame carrying the reciprocating ring rail. This operating interval, of course, is utilized only if a thread rupture has been detected at any delivery station serving one of the spindles of the array; the affected spindle is then deactivated and the monitoring carriage is halted in a confronting position to pick up the loose end and to retie it to the fresh thread coming from the associated supply reel or reels. The pick-up device, accordingly, may become operational anywhere along the path of the patrolling carriage.

Thus, the problem arises of correlating the reciprocatory component of the vertical displacement of a ring mounting with the operation of a service unit forming part of a horizontally moving carriage. The solutions heretofore proposed, involving a mechanical linkage between the ring rail and a carriage-supported switch, are relatively complex and correspondingly prone to malfunction.

OBJECT OF THE INVENTION

The object of my present invention, therefore, is to provide a simple system for enabling the activation of a normally deactivated service unit of a thread-monitoring carriage during a predetermined phase of a cycle of reciprocation of the ring mounting of an associated spindle bank.

SUMMARY OF THE INVENTION

I realize this object, in accordance with my present invention, by the provision of a signal generator disposed at a fixed location on a machine frame carrying constant-stroke drive means for the vertical reciprocation of an associated ring mounting. The signal generator is trippable by the drive means to emit an enabling pulse and, preferably, a subsequent disabling pulse in the course of a cycle of reciprocation to the controlled service unit to establish an interval during which that unit may intervene if necessary, e.g. upon the detection of a loose filament end, independently of a vertical shift superimposed upon that reciprocation.

The emitted signal pulses may be delivered to the horizontally movable carriage in a variety of ways, e.g. fluidically (via flexible conduits), optically, acoustically or by electromagnetic waves. I prefer, however, to transmit these pulses electrically via a metallic circuit including a conductor on a guide rail for the carriage and a brush on the carriage slidably contacting that conductor. The conductor could be connected to the power supply for the carriage drive, in which case the signal pulses should be readily distinguishable from the supply voltage by their magnitude, frequency and/or polarity or possibly by special coding. With a conductor particularly provided for signaling, simple d-c pulses will suffice.

If only a single enabling pulse is generated during a reciprocatory cycle, the operating interval may be terminated automatically after a predetermined period, e.g. as known per se from the aforementioned U.S. Pat. No. 3,641,758. Two consecutive pulses, if transmitted over the same conductor, may be distinguished from each other at the receiving end by a discriminator such as a flip-flop which is alternately set and reset by the oncoming pulses; in order to prevent a possible malfunction, the flip-flop may receive a separate resetting pulse upon movement of the carriage from one winding station to another.

The constant-stroke drive for the vertical reciprocation of the ring rail generally comprises two coacting members, namely a rotary cam and an associated cam follower. In the simplest case, the signal generator includes a switch and an actuator therefor, either the switch or the actuator (preferably the latter) being mounted on one of these two members. If the cam follower is used as the carrier for the actuator, the switch is tripped twice per cycle unless constructed to be only unidirectionally effective; the resulting two pulses may have an enabling and a disabling function, respectively, or the switch could be closed on one stroke and opened on the following return stroke. If the actuator is carried on the rotary cam, a second switch may be provided to generate the disabling pulse. Alternatively, the actuator may be split into two parts sequentially tripping the same switch. In each case the relative positions of the switch or switches and the actuator or actuators can be readily modified for varying the length of the operating interval and/or its time position within the cycle.

BRIEF DESCRIPTION OF THE DRAWING

The above and other features of my invention will now be described in detail with reference to the accompanying drawing in which.

SPECIFIC DESCRIPTION

Figure 1:
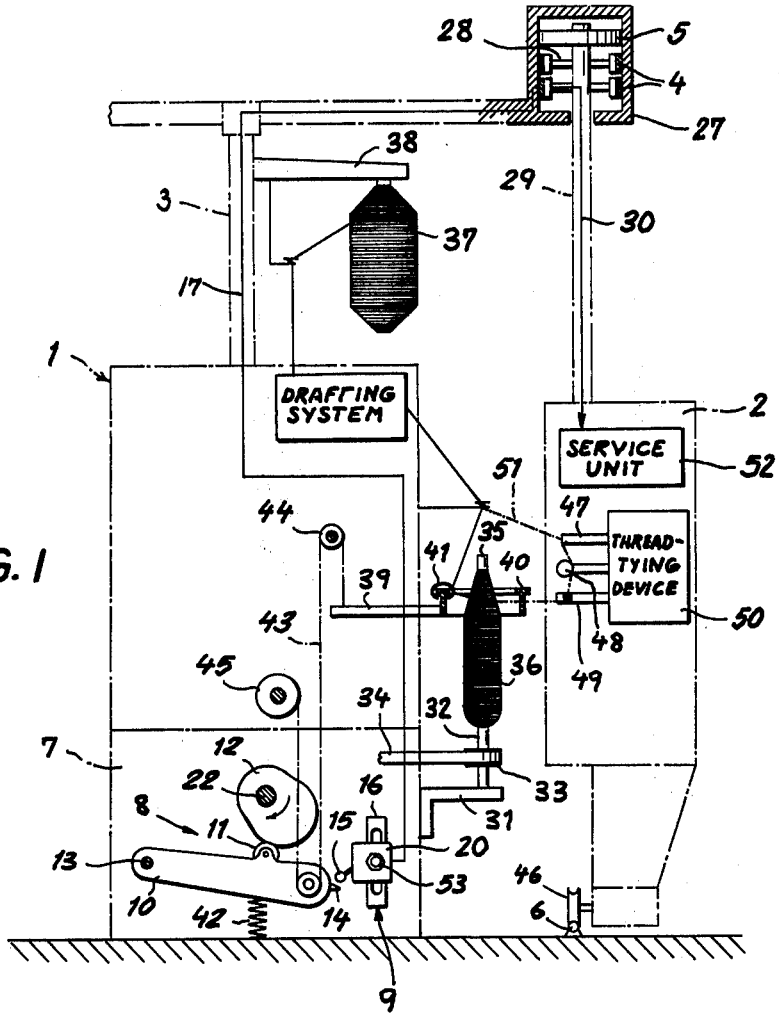
FIG. 1 is a diagrammatic elevational view of a generally conventional ring spinning machine and a confronting monitoring carriage, the machine being provided with signal-generating means according to my invention.

In FIG. 1 I have diagrammatically illustrated a ring spinning machine 1 including a fixed frame 31 supporting a linear array of spindles 32, only one of which has been shown. Each spindle 32 carries a pulley 33 driven from a motor (not shown) via a belt 34 for rotation about a vertical axis. A cop 35 on the spindle serves as a core for the winding of a yarn package 36 to which one or more threads are normally supplied from overhead reels 37 on a rack or creel 38. The spindles pass through apertures in a ring rail 39 serving as a mounting for respective spinning rings 40 which form tracks for revolving travelers 41.

The machine frame forms a transmission housing 7 containing a drive mechanism 8 for reciprocating the ring rail 39 with a constant vertical stroke superimposed upon a progressive upward shift. Drive mechanism 8 comprises a continuously rotating shaft 22 to which a rotary cam disk 12 is keyed. An arm 10, fulcrumed at 13 for swinging in a vertical plane, has a roller 11 that is urged by a spring 42 into contact with cam disk 12 as a follower thereof. The free end of arm 10 is linked with ring rail 39 by a chain or cable 43 wound about a deflecting roller 44 and anchored to a capstan 45 which is driven by a nonillustrated motor whereby the overall vertical movement of ring rail 39 is a composite of the relatively fast reciprocating traverse due to the swing of arm 10 and the relatively slow progressive shift resulting from the foreshortening of the effective length of link 43 by the capstan 45.

Also diagrammatically represented in FIG. 1 is a carriage 2 with wheels 46 riding on a pair of rails 6 (only one rail shown) which extend parallel to the ring rail 39 and the array of spindles 32. An overhead guide rail 27, extending in the same direction, brackets a roller 5 on a vertical shaft 29 carrying contact brushes 28 which slide along respective conductor bars 4 insulatedly supported on the inner wall of guide rail 27. Some of the bars 4 and brushes 28 are in series with a power supply for energizing a nonillustrated propulsion motor and other equipment aboard the carriage 2.

Mounted on carriage 2 is a conventional yarn-tying device, schematically indicated at 50, as well as an assembly for picking up a loose thread end and reinserting it into the associated traveler 41 preparatorily to a tying operation. The latter assembly, which may be of the type described in application Ser. No. 875,077 referred to above, comprises a suction tube 47, a deflecting roller 48 and a gripper arm 49. These elements rise and fall with the ring rail 39. A loose thread picked up by tube 47 and drawn by gripper 49 into contact with deflector 48 has been illustrated at 51.

In accordance with my present invention, a signal generator 9 is disposed in transmission housing 7 to control the operation of a service unit 52, associated with device 50, in the presence of a ruptured thread at any winding station of machine 1 confronted by carriage 2. The signal generator includes a switch 20 which is vertically adjustable, with the aid of a clamping bolt 53, on a slotted bracket 16 and has an operating lever 15 extending toward arm 10. A lug 14 on the free extremity of that arm serves as an actuator for the switch 20 by engaging the lever 15 twice per revolution of cam disk 12, i.e. during an ascending stroke and during a descending stroke of ring rail 39. If desired, lever 15 may be provided with an escapement so as to close the switch 20 only on one of these strokes, e.g. during the descent. The brief closure of switch 20 by the passing lug 14 completes a circuit from a nonillustrated voltage source via a lead 17, one of the conductors 4, the corresponding brush 28 and a lead 30 to the controlled service unit 52. Lead 17 is shown to pass along a structure 3 which supports the creel 38.

Figure 2:
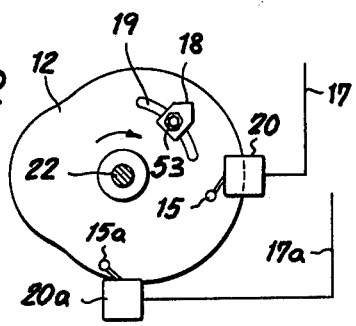
FIGS. 2, 3 and 4 are detail views of specific signal-generating means for the machine of FIG. 1.

FIG. 2 shows the cam disk 12 provided with a switch-actuating lug 18 which is adjustably mounted thereon with the aid of clamping bolt 53 traversing a slot 19. Switch 20, fixedly disposed near the disk periphery, is briefly closed once per revolution of shaft 22 by the coaction of lug 18 and operating lever 15. A similar switch **20*a*, with an operating lever 15*a*, is positioned adjacent the disk periphery with an angular spacing of about 90° from switch 20. Upon clockwise rotation of cam disk 12, switches 20 and 20*a* are successively tripped to generate an enabling and a disabling pulse, the latter being transmitted to service unit 52 (FIG. 1) via a lead 17*a* and a further conductor bar 4 and contact brush 28. The mounting of at least one of the two switches 20, 20*a* could also be made adjustable to change the length of the operating interval initiated by the tripping of switch 20 and terminated by the tripping of switch 20*a***.

Figure 3:
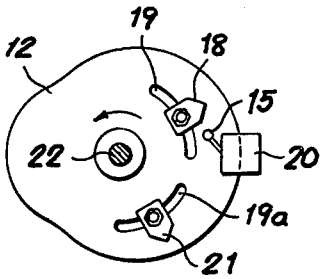

In FIG. 3 I have shown a kinematic reversal of the arrangement of FIG. 2, with a single switch 20 successively trippable by two actuating lugs 18 and 21 adjustably mounted in respective slots 19 and **19*a*** at angularly spaced locations.

Figure 4:
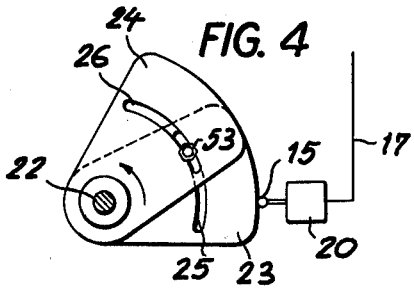

FIG. 4 depicts an arrangement generally similar to that of FIG. 3 wherein, however, the actuating lugs 18 and 21 have been replaced by two overlapping sectoral camming elements 23 and 24 mounted directly on disk shaft 22. The two sectors 23 and 24 are provided with respective arcuate slots 25 and 26 traversed by the clamping bolt 53 facilitating an adjustment of their degree of overlap and, therefore, of the angular extent of their combined camming edge serving to close the switch 20 by deflecting its operating lever 15. With one of the two sectors fixedly keyed to shaft 22 or adjustably secured thereto by a setscrew, switch 20 is closed for an interval depending upon the relative position of the two sections which in a limiting case could fully register with each other. A single such sector could be used, of course, if no change in the duration of the operating interval is required.

The signal generated on lead 17 by the switch 20 of FIG. 4 is thus a broad pulse distinct from the short enabling and disabling pulses produced by the arrangements of FIGS. 2 and 3. Such a broad pulse could also be generated by the assembly 9 of FIG. 1 if the switch 20 is designed to close on, say, an upswing of arm 10 and to open on a downswing thereof.

Figure 5:
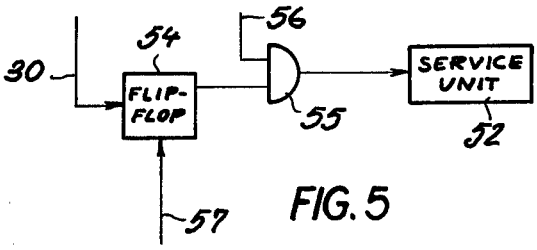
FIG. 5 is a circuit diagram of a signal receiver aboard the carriage of FIG. 1.

FIG. 5 shows a circuit for the control of service unit 52 (which could be used, for example, to activate the pick-up tube 47 prior to the operation of the reinsertion assembly 47–49) in response to two consecutive pulses per cycle emitted by the switch 20 of FIG. 3. Lead 30 terminates at a switching input of a flip-flop 54 which is alternately settable and resettable by incoming pulses. The set output of flip-flop 54 is connected to an input of an AND gate 55 also receiving, on another input tied to a lead 56, a consent signal from a nonillustrated master switch upon the detection of a ruptured thread; service unit 52 is operated upon the coincidence of this consent signal with the set state of the flip-flop. A further lead 57 energizes a separate resetting input of flip-flop 54 under the control of another signal source, not shown, either at the end of each revolution of shaft 22 (FIG. 3) or whenever the carriage 2 of FIG. 1 moves on from one winding station to the next, thereby preventing the flip-flop from remaining set if the switch 20 fails for any reason to emit exactly two pulses per cycle.

The circuitry of FIG. 5 can also be used with the signal generator 1 of FIG. 1 if the switch 20 thereof is tripped twice per cycle by the lug 14 to emit a pair of consecutive short pulses.

I claim:

1. In a thread-winding machine provided with an array of upright spindles surrounded by respective spinning rings forming tracks for thread-engaging travelers, a common mounting for said spinning rings vertically displaceable with reference to a machine frame, constant-stroke drive means on said machine frame coupled via a variable-length linkage with said mounting for imparting thereto a reciprocating vertical motion superimposed upon a separately generated progressive vertical shift resulting from changes in the effective length of said linkage, and monitoring means horizontally movable with reference to said machine frame along said array to check for and repair said ruptured threads, the combination therewith of signal-generating means disposed at a horizontally fixed location on said machine frame and directly coupled with said drive means for establishing a predetermined operating interval for a unit of said monitoring means during a selected phase of a cycle of reciprocation of said mounting, independently of said vertical shift.

2. The combination defined in claim 1 wherein said drive means comprises a rotary cam member and a cam-follower member co-operating therewith, said signal-generating means being controlled by one of said members.

3. The combination defined in claim 2 wherein said monitoring means comprises a carriage provided with a guide rail paralleling said array, said signal-generating means being connected to said unit through a circuit including a conductor on said guide rail and a brush on said carriage slidably contacting said conductor.

4. The combination defined in claim 2 wherein said signal-generating means comprises an actuator on said one of said members and a switch trippable by said actuator.

5. The combination defined in claim 4 wherein said actuator is mounted on said cam member.

6. The combination defined in claim 5 wherein said actuator is divided into two parts located in angularly separated positions on said cam member for tripping said switch twice per revolution of said cam member.

7. The combination defined in claim 6 wherein said parts are angularly shiftable with reference to said cam member.

8. The combination defined in claim 7 wherein said parts comprise a pair of adjustably overlapping sectoral camming elements mounted on a shaft of said cam member.

9. The combination defined in claim 5 wherein said switch is duplicated at two peripherally spaced-apart locations for successive tripping by said actuator during each revolution of said cam member.

10. The combination defined in claim 4 wherein said actuator is mounted on said follower member.

* * * * *